US005089088A

United States Patent [19]

Hendren et al.

[11] Patent Number: 5,089,088

[45] Date of Patent: Feb. 18, 1992

[54] LOW-DENSITY, HIGH STRENGTH ARAMID BOARDS

[75] Inventors: Gary L. Hendren, Richmond; Danny R. Ratliff, Powhatan, both of Va.

[73] Assignee: E. I. Du Pont de Nemours and Company, Wilmington, Del.

[21] Appl. No.: 662,210

[22] Filed: Feb. 28, 1991

[51] Int. Cl.[5] ..... D21H 13/26

[52] U.S. Cl. ..... 162/123; 162/132; 162/146; 162/149; 162/157.3; 162/206; 162/225

[58] Field of Search ..... 162/123, 129, 130, 157.3, 162/146, 132, 206, 225, 149

[56] References Cited

U.S. PATENT DOCUMENTS

| | | | |
|---|---|---|---|
| 3,756,908 | 9/1973 | Gross | 162/157.3 |
| 3,880,705 | 4/1975 | Tilburg | 162/101 |
| 4,515,656 | 5/1985 | Memeger, Jr. | 162/101 |
| 4,595,457 | 6/1986 | Nishiyama et al. | 162/123 |
| 4,752,355 | 6/1988 | Provost | 162/123 |
| 4,888,091 | 12/1989 | Nollen et al. | 162/109 |

FOREIGN PATENT DOCUMENTS

| | | | |
|---|---|---|---|
| 0128712 | 12/1984 | European Pat. Off. . | |
| 51-92400 | 8/1970 | Japan | 162/157.3 |

*Primary Examiner*—Peter Chin

[57] ABSTRACT

Flash expansion of moist multi-layered boards wherein each layer comprises aramid floc bonded by aramid fibrid results in high strength, low density aramid boards.

6 Claims, No Drawings

LOW-DENSITY, HIGH STRENGTH ARAMID BOARDS

BACKGROUND OF THE INVENTION

Aromatic polyamide boards are useful in many applications. In some it is important that such boards as well as those made from aramid fibrids and other floc, be of low density, e.g., below 0.45 g/cc. Unfortunately, it has been found that as low densities are achieved, the tensile strength is reduced to such low levels that the utility of the boards is compromised. The present invention provides an improved aramid board having the desired low density along with substantial tensile strength as well as a process for preparing it.

SUMMARY OF THE INVENTION

Comprehended by this invention is a process for making novel high strength, low density boards comprising:

a) preparing a wet laid sheet (waterleaf) from an aqueous slurry of 20–95% by weight of poly(m-phenylene isophthalamide) fibrids and 5–80% of floc which is non-melting below 340° C., preferably poly(m-phenylene isophthalamide floc:

b) combining the waterleaf into multiple layers to form a wet-lap;

c) hot pressing the wet-lap at 100° C. to 200° C. under pressure of 980 to 5880 kPa (10 to 60 kg/cm$^2$) to form a low density board having a calculated void volume of 30 to 60% by volume of the board;

d) allowing the low density board to recover at least about 5% but not more than 25% by weight of moisture by equilibration with the environment;

e) hot-pressing the moist board at a temperature between 200° C. and 315° C. and at a pressure between 2070 kPa (300 psig) and 10,340 kPa (1500 psig); and f) rapidly removing constraint to allow the board to expand to a desired predetermined volume so that its density is less than 0.45.

Also comprehended by this invention is a novel high strength low density, multi-layered board comprising floc, preferably poly(m-phenylene isophthalamide) floc bonded by poly(m-phenylene isophthalamide) fibrids, each layer being fusion bonded to adjacent layers at spaced contact areas randomly disposed throughout the thickness of the board, the major surfaces of the board being substantially smooth and continuous, and the said board having a density of from 0.14 to 0.45 g/cc and a tensile strength greater than 9650 kPa (1400 psi).

DETAILED DESCRIPTION OF THE INVENTION

The present invention provides high strength, low density boards of floc and aramid fibrids. The tensile strength of aramid pressboard from floc and fibrids in general decreases as the density decreases. Surprisingly, boards of the invention exhibit tensile strengths in excess of 9650 kPa (1400 psi) at densities of less than 0.45 g/cc. This unusual behavior is believed due in part to the crystalline nature of the product which is significantly greater than that of other pressboards of these materials.

Products of the present invention may be prepared starting with what is referred to as "Standard Pressboard" in U.S. Pat. No. 4,752,355. It is made from a refined aqueous slurry of poly(m-phenylene isophthalamide) fibrids and floc. Floc (short fiber) of other materials which do not melt below 340° C. may be employed in place of the poly(m-phenylene isophthalamide). Illustrative of such floc is the commercially available poly(p-phenylene terephthalamide) floc. The combination of fibrids and floc in the slurry can range from 20–95% fibrids and 5–80% floc on a weight basis. After refining, the slurry is converted to a sheet of wet paper (a waterleaf), the moisture content adjusted to about 400% based on solids and a number of such sheets are overlapped. The multilayered product is then hot-pressed at 100° C. to 200° C. under a pressure of 980 to 5880 kPa (10 to 60 kg/cm$^2$) to form a low density board having a calculated void volume of 30 to 60% by volume of the board as described in U.S. Pat. No. 4,752,355. This low density pressboard or similar product using a different floc, can serve as the starting material for manufacture of products of this invention by first allowing it to recover, at ambient temperature, at least about 5% but not more than 25% by weight of moisture. Too little moisture is inadequate for the purpose of serving as an expansion agent in subsequent processing. On the other hand, too great a moisture content will cause the product to come apart in the subsequent rapid expansion step.

After the "Standard Pressboard" has recovered the moisture, it may be placed in a rapid opening press and is rapidly, e.g., within one minute, brought up to a temperature of 200° C. to 315° C. preferably 260° C. to 290° C., about the temperature of the press, and to a pressure of from 2070 kPa to 10,340 kPa (300 to 1500 psig), preferably from 4830 to 10,340 kPa (700 to 1500 psig). Constraint is then instantaneously removed (within one second) by opening the press to allow the expanding pressboard to occupy a predetermined volume whereby the density of the pressboard is less than 0.45 g/cc.

The product has a smooth continuous surface and a density of from 0.14 to 0.45 g/cc. It is strong, having a tensile strength greater than 9650 kPa (1400 psi). Preferred products of the invention made from p(m-phenylene isophthalamide fibrids) and p(m-phenylene isophthalamide floc) have a crystallinity as shown by heat absorbency at the glass transition temperature, Tg, of less than 0.8 joule/g.

TEST AND MEASUREMENTS

Density is measured by cutting the board into a rectangular sample at least 10 cm by 10 cm, making sure that the corners are cut square so that the upper and lower faces of the sample are of the same area and that the dimensions can be measured accurately. The length and width of the sample are measured to an accuracy of at least 0.25 cm. The thickness of the samples is measured in at least 5 places substantially equally spaced apart around all sides of the sample using a micrometer caliper (for example, Mitutoyo Model 189-129), to an accuracy of at least 0.00025 cm, averaging the thickness measurements. The sample is then weighed to the nearest 0.0001 g. The volume of the board is calculated in cm$^3$ and the weight is divided by the volume to give the density of g/cm$^3$.

Tensile Strength is measured in accordance with ASTM D202 on a conventional tensile testing machine (e.g., the Tinius Olsen Tensile Tester model Super "L", serial no. 14660, made by the Tinius Olsen Universal Testing Machine Co., Inc., Easton Rd., Willow Grove, Pa. 19090).

Heat absorbed by the Tg is determined using a thermal analyzer (e.g. Thermal Analyzer Model 2100 with a Differential Scanning Calorimeter [DSC] Model 2910 from Du Pont Instruments. The Tg is in the range of 287° to 294° C. The following thermal cycle is run on the sample:

Room temperature to 180° C. until equilibrated at 180° C.
180° C. to 340° C. at 50° C./min
Hold at 340° C. for 2 minutes
340° C. to 180° C. at 10° C./min
Hold at 180° C. for 2 minutes
180° C. to 340° C. at 50° C./min The absorption analysis is done by the computer program (Peak Integration module of the DSC Standard Data Analysis Program, version 4.0 from Du Pont Instruments). The user chooses two points before and after the Tg. The computer program automatically finds the beginning and the end of the Tg change and determines the heat absorbed during the change. The desired analysis is done on the second run from 180° C. to 340° C.

The following examples are illustrative of this invention and are not to be construed as limiting.

EXAMPLE 1

A 20 cm×20 cm sheet of "Standard Pressboard" was prepared as described in part A of Example 1 of U.S. Pat. No. 4,752,355 except that the board thickness was only 2.0 mm because of fewer overlaps of the wet sheet on the cylindrical tube. The sheet which was permitted to equilibrate with the atmosphere and absorbed about 6 to 8% of moisture on a weight basis was put into a rapid opening, high temperature press (Hydropress Model MTP-8 Super Basic, Serial No. 34). The sample was pressed at 293° C. (560° F) and at a pressure of 70 kg/sq. cm (6900 kPa; 1000 psig) for one minute to bring the board to about the temperature of the press. The pressure was then instantaneously removed (within a second) and the pressboard expanded to about 3.5 time its former thickness. The final product had a density of 0.283 g/cc and a tensile strength of 13,700 kPa (1987 psi).

In the process of manufacture, a significant increase in crystallinity resulted. The level of crystallinity of the final product was measured indirectly as described above by the amount of heat absorbed by the board at its Tg and found to be 0.2817 joules/gm.

The major surfaces of the board were smooth and continuous.

EXAMPLE 2

The procedure of Example 1 was repeated except that the initial board had a thickness of 6.0 mm as a result of more overlaps of the wet sheet in making the "Standard Pressboard". The final product had expanded to about 4 times its original thickness. It had a density of 0.245 g/cc and a tensile strength of 9800 kPa (1422 psi). The amount of heat absorbed by the board at its Tg was 0.3455 Joules/g.

EXAMPLE 3

Two 20 cm×20 cm sheets of "Standard Pressboard" were prepared as described in part A of Example 1 of U.S. Pat. No. 4,752,355 except that the board thicknesses were 4.0 mm as a result of more overlaps of the wet sheet in making the "Standard Pressboard". The sheets which were permitted to equilibrate with the atmosphere and absorbed about 6 to 8% of moisture on a weight basis were placed one on top of the other and the procedure of Example 2 was repeated. The two sheets were bonded at their interface and the final product having a thickness of about 3.33 cm, and a density of 0.22 g/cc was obtained.

We claim:

1. A low density, high strength, board of multiple layers, each layer comprising from 5–80% by weight of a floc which is non-melting below 340° C. and is bonded by from 20 to 90% by weight of poly(m-phenylene isophthalamide) fibrids, and with each layer being fusion bonded to adjacent layers at spaced contact areas randomly disposed throughout the thickness of the board, the major surfaces of the board being substantially smooth and continuous, and the said board having a density of from 0.14 to 0.45 g/cc and a tensile strength greater than 9650 kPa.

2. A board according to claim 1 in which the floc is poly(m-phenylene isophthalamide floc and which has a heat absorbency at the Tg of less than 0.8 joule/g.

3. A process for preparing a low density, high strength board of multiple layers comprising:

a) preparing a wet laid sheet (waterleaf) from an aqueous slurry of 20–95% by weight of poly(m-phenylene isophthalamide) fibrids and 5–80% by weight of floc;
b) combining the waterleaf into multiple layers to form a wet-lap;
c) hot pressing the wet-lap at 100° C. to 200° C. under pressure of 980 to 5880 kPa to form a low density board having a calculated void volume of 30 to 60% by volume of the board;
d) allowing the low density board to recover at least about 5% but not more than 25% by weight of moisture by equilibration with the environment;
e) hot-pressing the moist board at a temperature between 200° C. and 315° C. and at a pressure between 2070 kPa and 10,340 kPa and
f) rapidly removing constraint to allow the board to expand to a desired predetermined volume so that its density is below 0.45 g/cc.

4. A process according to claim 3 wherein the floc is poly(m-phenylene isophthalamide) floc.

5. The process of claim 3 wherein hot-pressing of step (e) is conducted between 260° C. and 290° C. and at a pressure between 700 and 1500 psig.

6. The process of claim 3 wherein a plurality of equilibrated low density boards from step d) are placed one on top of the other and hot pressed at a temperature between 200° C. and 315° C. and at a pressure between 2070 kPa and 10,340 kPa before rapid removal of constraint to allow the combined boards to expand to a desired predetermined volume.

* * * * *